US009286785B2

(12) United States Patent
Hinkel et al.

(10) Patent No.: US 9,286,785 B2
(45) Date of Patent: Mar. 15, 2016

(54) ANTI-THEFT DEVICE FOR INTERCOM SYSTEMS

(75) Inventors: Ralf Hinkel, Horingen (DE); Dirk Tiemann, Orbis (DE)

(73) Assignee: Mobotix AG (DE)

( * ) Notice: Subject to any disclaimer, the term of this patent is extended or adjusted under 35 U.S.C. 154(b) by 240 days.

(21) Appl. No.: 14/003,465

(22) PCT Filed: Mar. 9, 2012

(86) PCT No.: PCT/DE2012/000241

§ 371 (c)(1),
(2), (4) Date: Nov. 11, 2013

(87) PCT Pub. No.: WO2012/119594

PCT Pub. Date: Sep. 13, 2012

(65) Prior Publication Data

US 2014/0125484 A1 May 8, 2014

(30) Foreign Application Priority Data

Mar. 10, 2011 (DE) ..... 10 2011 013 525
Mar. 14, 2011 (DE) ..... 10 2011 014 013

(51) Int. Cl.

| | |
|---|---|
| ***G08B 1/08*** | (2006.01) |
| ***G08B 25/00*** | (2006.01) |
| ***G08B 29/04*** | (2006.01) |
| ***E05B 65/00*** | (2006.01) |
| ***E05C 3/12*** | (2006.01) |
| ***E05B 47/00*** | (2006.01) |
| *E05B 1/00* | (2006.01) |
| *E05B 15/04* | (2006.01) |

(52) U.S. Cl.

CPC ..... *G08B 25/008* (2013.01); *E05B 47/0004* (2013.01); *E05B 65/006* (2013.01); *E05C 3/12* (2013.01); *G08B 29/046* (2013.01); *E05B 1/00* (2013.01); *E05B 2015/0448* (2013.01); *E05B 2047/0058* (2013.01); *Y10T 16/00* (2015.01)

(58) Field of Classification Search

CPC ..... E05B 1/00; Y10T 16/00
See application file for complete search history.

(56) References Cited

U.S. PATENT DOCUMENTS

2004/0159134 A1* 8/2004 Eichenauer ..... E05B 47/0046 70/278.1

FOREIGN PATENT DOCUMENTS

| | | |
|---|---|---|
| CN | 1294431 | 5/2001 |
| EP | 1 089 249 | 4/2001 |
| EP | 1 870 286 | 12/2007 |
| FR | 2 955 346 | 7/2011 |
| WO | 2006/114618 | 11/2006 |

* cited by examiner

*Primary Examiner* — Shirley Lu
(74) *Attorney, Agent, or Firm* — Salter & Michaelson

(57) ABSTRACT

A module frame for bell system modules having a module locking means for locking modules, which are to be inserted, to the frame and having a locking canceling means for canceling locking during actuator excitation. In the process, provision is made for the locking canceling means to also exhibit actuator-independent permanent catch blocking which can be selectively activated.

13 Claims, 3 Drawing Sheets

ANTI-THEFT DEVICE FOR INTERCOM SYSTEMS

TECHNICAL FIELD

The present invention relates to the subject matter claimed in the preamble and therefore concerns the protection of modular bell systems.

BACKGROUND OF THE INVENTION

Bell systems are used on house doors, access barriers and the like; in the present case, they are synonymously also referred to as intercom systems or access control systems. Depending on the object on which the bell system is used, the user will require different functions to be implemented in order to meet his specific requirements. For example, users require that, in addition to a pure bell function by means of which even several parties can be separately and independently informed of a person seeking access, a talk-back function is implemented, a video image is recorded and transmitted, or a preferably backlit house number is displayed.

In order to meet these various requirements, it is known to provide frames of different sizes in which different modules can be inserted in order to implement the desired functions. Camera modules, talk-back modules, single bell modules, symbol display modules, multiple bell modules, number block modules, security access modules and modules which combine several of the cited functions, amongst others, should be mentioned here.

In the present case, systems are to be understood to be a bell system particularly when they do not have an actual bell button but implement at least one of the cited functions.

While this use of modules which can be inserted into the frame can result in a significant reduction in production and storage costs, problems may arise when the bell system is mounted on an object which is situated in an area which is at risk of theft or vandalism or in which acts of sabotage cannot be precluded. In a situation such as this, there is a risk of the modules being removed from the frame and being re-inserted in an inoperative state or being stolen.

In principle, it would be possible to connect the modules in a permanent and fixed manner to the frame after said modules have been inserted, for example by latching said modules into place, in order to prevent theft and sabotage, but permanent connection of this kind again creates problems if the modules have to be replaced, for example due to defects or because the functions required by the user have changed.

It has therefore already been proposed to provide a latching mechanism which fixes the individual modules to the frame using moving latching lugs. The movement of the latching lugs then releases the modules again and is effected in commercially available frames by exciting a monostable electromagnetic actuator, the modules being locked in the stable position of said actuator.

This makes it easier to subsequently replace modules but has proven complicated in terms of initial installation, in particular, because the modules still have to be repeatedly removed from the frame and re-inserted specifically during installation, typically initially for the purpose of checking the connection and for the purpose of adjusting the module arrangements in the frame, etc.

It would be desirable to be able to specify a bell system which ensures a high level of security at low cost yet is simple to assemble.

The object of the present invention is to provide a novel subject matter for industrial use.

The way in which this object is achieved is claimed in independent form. Preferred embodiments can be found in the dependent claims.

SUMMARY OF THE INVENTION

A basic concept of the present invention accordingly proposes forming a module frame for bell system modules having a module locking means for locking modules, which are to be inserted, to the frame and having a locking canceling means for canceling locking during actuator excitation such that the locking canceling means also exhibits mechanical and actuator-independent permanent catch blocking which can be selectively activated.

Therefore, it is no longer necessary for the actuator to be excited each time a module is mounted or removed for test purposes, this being difficult particularly when there is still no power supply, but rather mounting which is not influenced by a locking system can initially be permitted by simple mechanical blocking and the mechanical catch blocking can be canceled only after said mounting is complete. This method makes mounting considerably easier.

It is preferred for the module frame to be designed such that the locking canceling means comprises a linearly moving element which engages, so as to cancel locking, with the module locking means depending on the displacement position, with the locking means comprising, in particular, pivotable elements and it being possible to determine the pivot position in response to the assumed linear position.

Therefore, the invention requires only minor modifications to the frame in relation to prior art arrangements, this in turn leading to the possibility of the module frame of the present invention being used with a large number of existing, conventional modules.

It is also preferred for the locking canceling means to comprise a rotatable element which, in at least one rotation position, pushes the linearly moving element into a first linear position for permanent catch blocking and which, in at least a second rotation position, allows movement of the linearly moving element into a locking position, in particular in such a way that the excitable actuator can move the linearly moving element out of this locking position.

If a rotation element is provided in order to mechanically provide permanent catch blocking, said rotation element can preferably be operated from the top.

It is preferred for the module locking means for at least one module to be arranged in the frame in a concealed manner; this can be performed, for example, by accommodating the associated elements in cavities which are formed between the frame and the wall during use. For optical reasons and for reasons of stability, the frames will typically already be of a certain size, in particular width of the edges, and at the same time not be of solid form for cost and manufacturing reasons. It is therefore readily possible to arrange the locking means here. It may then only be necessary to operate the mechanically operated element for the purpose of permanent catch blocking from the top of the frame; however, little space is required for this purpose, and therefore this mechanically operated element can again be concealed by a module, which can be inserted after the blocking action is released, during use.

It is possible and preferred for the locking canceling means to act on all modules which are to be arranged in the frame. This is primarily readily possible when the locking canceling means are arranged in a frame web between two modules and the modules are blocked by the frame edge. The locking canceling means can then generate a movement of a linearly positionable element toward the frame edge and away from said frame edge; using a force transmission strip which runs along the frame edge and therefore along the locking systems, which are arranged on the frame edge, of the individual modules, the locking system can then be blocked by virtue of the movement of the linearly positionable element.

The module frame is preferably designed to be mounted on a wall and, in the direction of the wall, provided with fastening holes and passage holes for connection cables and the like.

Protection is also claimed for a bell system having a module frame according to the invention, in particular when this bell system comprises at least one of the modules which is selected from the group comprising a camera module, a talk-back module, a single bell module, a symbol display module, a multiple bell module, a number block module and a security access module.

Protection is further claimed for a method for assembling a bell system according to the invention, wherein the module frame is mounted, modules are mounted in a mechanically permanently catch-blocked state and tested as required, and only then is the permanent catch blocking canceled.

DESCRIPTION OF THE DRAWINGS

The invention will be described, merely by way of example, with reference to the drawing, in which:

FIG. 4 shows a section through a module frame 1 of a bell system.

Figures 1, 2, 3:
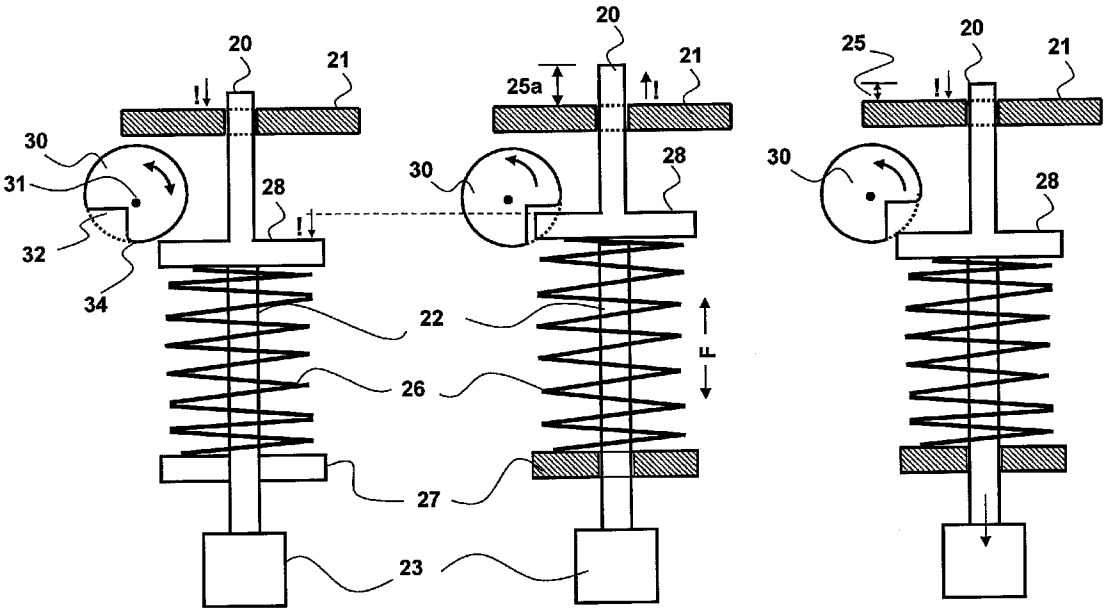
FIG. 1 shows a plan view of a locking canceling means, which is arranged in a module frame intermediate web, while the catch is permanently mechanically blocked according to the invention.
FIG. 2 shows the locking canceling means, which is arranged in a module frame intermediate web, of FIG. 1 in a state in which there is no catch blocking.
FIG. 3 shows the locking canceling means, which is arranged in a module frame intermediate web, of FIG. 1 in a state in which catch blocking is effected by actuator excitation, that is to say the modules can be removed without being blocked.
Figure 4:
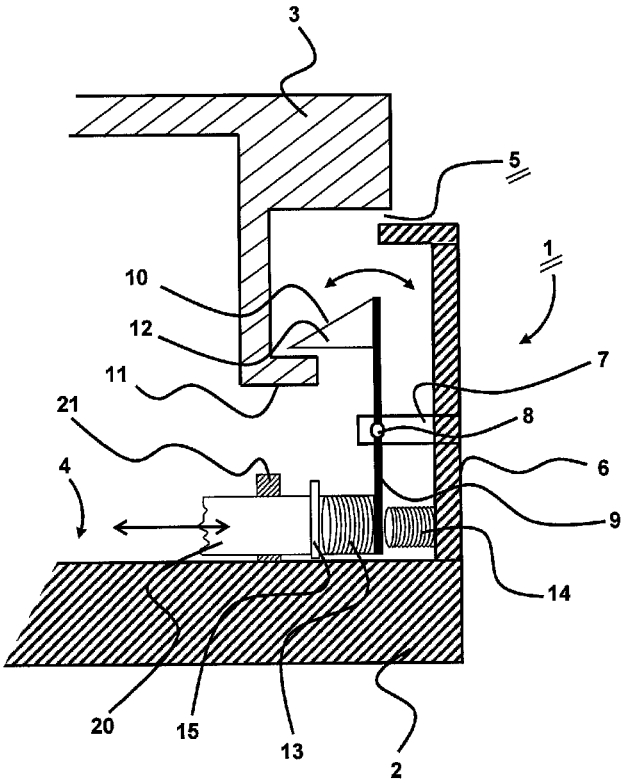
FIG. 4 shows a diagram, which is used for better understanding, of a module locking system in a sectional view through a frame level with a frame web with a plan view of a pivotable locking system, an inserted module and the end part of the locking canceling system.

The module frame 1 comprises a base 2 on the wall side, said base having perforations, as is customary, at the points (not shown) which are required for mounting and being arranged for accommodating several modules next to one another. A respective web 4 is left between the modules.

DETAILED DESCRIPTION

The module frame 1 has an edge and the modules project beyond said edge, cf. projection region 5.

A catch 9 is then arranged between the projection region 5 and the base. Said catch is—for better understanding—shown here as being pivotable about an axis 8 on an arm 7 which protrudes from the frame edge 6. It should be noted that a practical embodiment can be designed differently, as will be shown below with reference to FIGS. 5 and 6, but that the design described here serves to improve understanding of the locking system according to the invention.

The catch 9 has a catch lug 12 with a beveled surface 10 in the direction of the top of the frame, it being possible for a module lower edge 11 to slide on said beveled surface and this moving the catch lug in the direction of the module edge 6, in the explanatory example shown here by the catch pivoting about the axis 8. As soon as the module edge 11 has moved past the catch 9, the return movement of the module, that is to say the movement of the module away from the frame, is prevented as long as the catch lug 12 is not pivoted toward the module frame edge 6.

In order to now keep the catch lug 12 in this locking position, the catch lug 12 is pressed against the module. To this end, a linearly displaceable element 20 is provided beneath the axis 8 in the illustrated example, said element being pressed against the frame edge.

In this case, a spring 13 is provided between the lower arm of the catch 9 and the displaceable element 20, said spring holding the catch 9 in the catch position without an external force but allowing the catch lug 12 to return to such an extent that the module 3 can still be inserted in the event of forces acting on the beveled surface 10, despite the linearly displaceable element 20 creating a barrier, when a module is inserted.

A compression spring 14 is also arranged between the catch 9 and the frame edge 6, said compression spring pressing the lower catch arm away from the frame edge without any counteracting forces from the linearly displaceable element 20, this moving the catch lug 12 away from the module edge, and therefore said catch lug no longer engaging over the collar-like module edge and it being possible to freely remove the module.

The movement of the linearly displaceable element 20 can therefore be used to establish whether only module insertion, but not module removal, is intended to be possible or whether module removal is also possible.

A force transmission strip 15 which runs along the frame edge 6 is also shown, it being possible to use the force transmission strip to influence all the module catches which are provided along the frame edge 6 in the same way in accordance with the linear position of the displaceable element 20.

A partition wall 21 through which the linearly displaceable element passes and which is part of the frame web is also illustrated.

The described arrangement is still conventional in this respect even though the structural configuration of the corresponding elements both of conventional arrangements and also of the invention can differ from the embodiment described above for explaining functioning.

Figure 5:
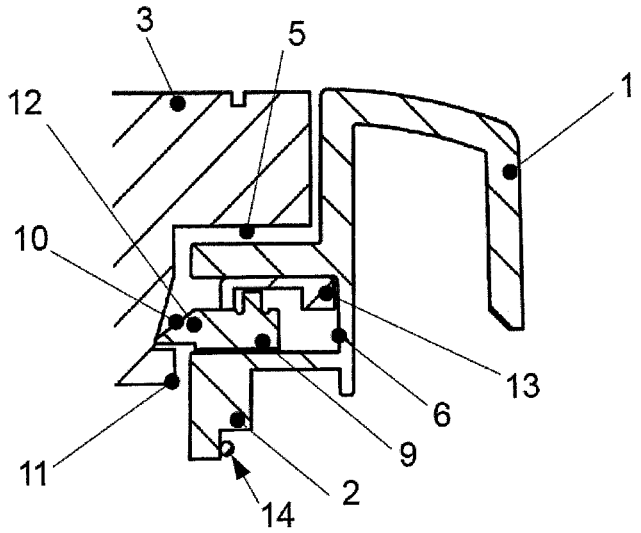
FIG. 5 shows a sectional view through an exemplary embodiment of a variant which has actually been manufactured.
Figure 6:
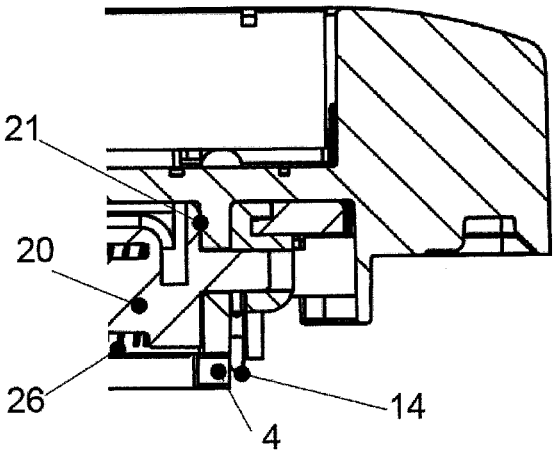
FIG. 6 shows a further sectional view through the variant of FIG. 5.

However, it is clear from the above that locking can be permitted or prevented by a linearly moving element. A further embodiment of a catch in which this is likewise the case will now be described. Reference will be made to FIGS. 5 and 6 in this respect.

For the most part, the same reference symbols are used in FIGS. 5 and 6 to identify identical or similar elements. However, in order to make it clear that reference is being made to a different exemplary embodiment in the text which follows, a Roman numeral II is added, only in the text of the description, to the reference symbol for the second variant.

FIGS. 5 and 6 again show a section through a module frame 1II of a bell system.

The module frame 1II again comprises a base 2II on the wall side, said base having perforations, as is customary, at the points (not shown) which are required for mounting and being arranged for accommodating several modules next to one another. A respective web 4II is also left between the modules.

The module frame 1II has an edge and the modules project beyond said edge, cf. projection region 5II.

A catch 9II is again provided in the projection region 5II. This catch 9II has a catch lug 12II with a surface 10II which is beveled in the direction of the top of the frame, it being possible for a module lower edge 11II to slide on said surface, this moving the catch lug 12II in the direction of the module edge 6II. As soon as the module edge 11II has moved past the catch 9II, the return movement of the module, that is to say the movement of the module away from the frame, is prevented as long as the catch lug 12II is not moved toward the module frame edge 6II.

In order to now keep the catch 9II in this locking position, said catch is pressed against the module by a spring 14II.

In this case, a spring 14II is provided between the lower arm of the catch 9II and the displaceable element 20II, said spring holding the catch 9II in the catch position without an external force but allowing the catch lug 12II to return to such an extent that the module 3II can still be inserted in the event of forces acting on the beveled surface 10II, despite the linearly displaceable element 13II creating a barrier, when a module is inserted.

In this case, the linearly displaceable element 13II is provided between the catch lug 12II and the frame edge 6II, this moving the catch lug 12II away from the module edge, and therefore said catch lug no longer engaging over the collar-like module edge and it being possible to freely remove the module.

The movement of the linearly displaceable element 20II can therefore be used to establish whether only module insertion, but not module removal, is intended to be possible or whether module removal is also possible.

A force transmission strip 15II which runs along the frame edge 6II is also shown, it being possible to use the force transmission strip to influence all the module catches which are provided along the frame edge 6II in the same way.

A partition wall 21II through which the linearly displaceable element passes and which is part of the frame web is also illustrated.

While the above text described the possible locking systems and the possible ways of blocking said locking systems by linearly moving elements, the text which follows will now indicate how a locking system can be blocked according to the invention. To this end, blocking of a locking system in accordance with the invention will now be described with reference to FIGS. 1 to 3.

The linearly displaceable element which passes through the wall 21 is routed further over an elongate region 22 as far as an electromagnetically excitable actuator 23.

The electromagnetically excitable actuator 23 can be excited by a power source, which is provided outside the frame, via a power supply line (not shown). The power source can either be provided remote from the frame, for example in a house on which the bell system is used, or, for example, in a module, for example implemented with an emergency battery. If the power source is arranged in a module, for example a touch panel, a key combination may be determined which, when it is entered, activates the power source.

The power source is designed such that the actuator is excited only for a specific time and then excitation ends.

The actuator 23 is monostable, said actuator retracting the linearly displaceable element in the excited state, cf. FIG. 3, arrow 25, while the linearly displaceable element is extended without actuator excitation, cf. FIG. 2, arrow 25*a*. As shown, arrow 25 is shorter than arrow 25*a* in accordance with the different magnitude of extension.

In order to reach the position of the linearly displaceable element 20 in which it is extended to a great extent which is desired in the state without actuator excitation, a compression spring 26 is provided which is supported firstly on an intermediate wall 27 which is provided between the actuator 23 and the wall 21, and secondly is supported on the displaceable element 20, specifically, in this case, on a widened portion 28 which is provided in the elongate region 22 of the element 20.

This elongate region 22 is arranged at a distance from the wall 21, specifically at such a distance that there is space for a rotatable element 30 laterally next to it but level with the spacing. This rotatable element 30 implements, as will be shown below, mechanical permanent blocking for the locking system in the following way. It is therefore an actuator-independent locking canceling means which provides permanent catch blocking.

The rotatable element is not rotationally symmetrical, but rather has a cutout 32. In this case, said cutout is illustrated approximately at a right angle, with the transitions to the rest of the contour of the circle being rounded, cf. reference numeral 34.

The rotatable element can be rotated about an axis 31 which is perpendicular to the frame base. In this case, the rotatable element reaches (not illustrated) into the region of the web upper edge which, however, is covered by projecting modules during operation. A contouring, for example in the form of a cross-shaped slot, is provided there in order to turn the rotatable element between 2 positions which can be distinguished in FIGS. 1 and 2.

In one of the rotation positions, cf. FIG. 2, the cutout 32 in the rotation element 30 is positioned such that the widened portion 28 comes to rest in it. This allows the linearly displaceable element 20 to assume a position which is extended to such an extent that the locking system is active.

In the other rotation position, cf. FIG. 1, the displaceable element 20 is pushed away from the wall 21 by the rotation element 30 against the force of the compression spring 26 by virtue of said rotation element engaging with the widened portion 28, and therefore the locking system is not active.

The arrangement is used as follows:

The frame is first fixed to the wall in a conventional manner. A check is then made to ensure that the catch blocking element is in its latching-in prevention position, that is to say the catch mechanism is inoperative.

The modules which are intended for the frame are inserted into their respectively provided positions in the frame and a check is made to ensure that they function without problems. If this is not the case, or if the user decides, shortly after mounting, to change the positions of the modules, the modules which are inserted into the frame can be easily removed.

As soon as the functional test as part of assembly is complete, that module which is located in front of the catch blocking means is removed. Rotation of the catch blocking means which can now be reached from the top of the frame moves the locking system to its locking inoperative position under the action of the compression spring.

The modules which are still located in the frame are already locked as a result, without the re-insertion of the module which was removed for activating the locking system being adversely affected.

The module which was initially removed for activating the locking system is then re-inserted into the frame, after which the locking system also snaps in in this case. Therefore, all the modules are locked.

The arrangement can now be used such that it is protected against theft and sabotage. The locking system prevents removal of the modules without tools and, even with tools, theft is possible only by destroying the arrangement; the traces left behind on the frame in the process at the same time provide effective protection against attempts at sabotage.

If a module is intended to be replaced after some time, for example in order to meet the desire for changed functions, the electromagnetic actuator is excited and draws the catch blocking means into the catch-releasing position.

This can be done from inside the object, for example by transmitting suitable control signals or by operating specific keys or sequences of keys on one of the modules, this temporarily exciting the electromagnetic actuator by means of the logic circuit provided in said module.

In this case, the circuit which is used for exciting the actuator ensures that this excitation of the electromagnetic actuator is only temporary, so that protection against theft is again automatically ensured after the excitation time has elapsed, without additional operation. Therefore, accidental unlocking generally has no consequences.

In contrast, the modules can be removed without locking during the time at which the electromagnetic actuator is excited. If, in this case, the module is removed before the catch blocking, the catch bar can at the same time be returned to the catch-blocking position on the frame. This allows new testing of the modules which are then to be installed and, after the test is complete, the protection means can again be activated and the module concealing said means can be re-inserted.

It is accordingly possible for the arrangement to be operated in a reversible protected or unprotected manner.

What is claimed is:

1. A module frame for bell system modules comprising:

a means for locking modules, which are to be inserted, to the frame and, a means for canceling locking during actuator excitation, wherein the means for canceling locking also exhibits actuator-independent and selectively activated permanent catch blocking, wherein the means for locking comprises a linearly moving element and a rotatable element, said rotatable element, in at least one rotation position, pushes the linearly moving element into a first linear position for permanent catch blocking and which, in at least a second rotation position, allows movement of the linearly moving element into a locking position, in such a way that the excitable actuator can move the linearly moving element out of this locking position.

2. The module frame as claimed in claim 1, wherein the linearly moving element engages, so as to cancel locking, with the module locking means depending on a displacement position, with the means for locking comprising pivotable elements and it being possible to determine the pivot position in response to the assumed linear position.

3. The module frame as claimed in claim 2, wherein the means for canceling locking comprises a rotatable element which, in at least one rotation position, pushes the linearly moving element into a first linear position for permanent catch blocking and which, in at least a second rotation position, allows movement of the linearly moving element into a locking position, in particular in such a way that the excitable actuator can move the linearly moving element out of this locking position.

4. The module frame as claimed in claim 1, wherein the rotatable element can be operated from the top.

5. The module frame as claimed in claim 1, wherein at least one means for locking for at least one module is arranged in the frame in a concealed manner.

6. The module frame as claimed in claim 1, wherein the means for canceling locking acts on all modules which are to be arranged in the frame.

7. The module frame as claimed in claim 1, wherein it is designed to be mounted on a wall.

8. The module frame as claimed in claim 1, wherein the rotatable element can be operated from the top.

9. The module frame as claimed in claim 8, wherein at least one module locking means for at least one module is arranged in the frame in a concealed manner.

10. The module frame as claimed in claim 9, wherein the locking canceling means acts on all modules which are to be arranged in the frame.

11. A bell system having a module frame for bell system modules and comprising:

a means for locking modules, which are to be inserted, to the frame and, a means for canceling locking during actuator excitation, wherein the means for canceling locking also exhibits actuator-independent and selectively activated permanent catch blocking, wherein the means for locking comprises a linearly moving element and a rotatable element, said rotatable element, in at least one rotation position, pushes the linearly moving element into a first linear position for permanent catch blocking and which, in at least a second rotation position, allows movement of the linearly moving element into a locking position, in such a way that the excitable actuator can move the linearly moving element out of this locking position.

12. The bell system as claimed in claim 11, wherein at least one of the modules is selected from the group comprising a camera module, a talk-back module, a single bell module, a symbol display module, a multiple bell module, a number block module and a security access module.

13. A method for assembling a bell system as claimed in claim 11, wherein the module frame is mounted, modules are mounted in a mechanically permanently catch-blocked state and tested as required, and only then is the permanent catch blocking canceled.

* * * * *